US010622754B2

(12) United States Patent
Mamiya et al.

(10) Patent No.: US 10,622,754 B2
(45) Date of Patent: Apr. 14, 2020

(54) CONNECTOR

(71) Applicant: Sumitomo Wiring Systems, Ltd., Yokkaichi, Mie (JP)

(72) Inventors: Yuma Mamiya, Mie (JP); Yujiro Imai, Mie (JP); Shinjiro Kida, Mie (JP); Masami Kawamoto, Mie (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 16/262,139

(22) Filed: Jan. 30, 2019

(65) Prior Publication Data

US 2019/0252818 A1 Aug. 15, 2019

(30) Foreign Application Priority Data

Feb. 15, 2018 (JP) ..... 2018-024606

(51) Int. Cl.
*H01R 13/50* (2006.01)
*H01R 13/504* (2006.01)
*H01R 13/436* (2006.01)

(52) U.S. Cl.
CPC ..... *H01R 13/5045* (2013.01); *H01R 13/4365* (2013.01)

(58) Field of Classification Search
CPC ..... H01R 13/436; H01R 13/4364; H01R 13/4365
See application file for complete search history.

(56) References Cited

U.S. PATENT DOCUMENTS 5,913,697 A * 6/1999 Myer ..... H01R 13/4365 439/595
2018/0076576 A1 3/2018 Ito et al.

FOREIGN PATENT DOCUMENTS

JP 2016-178076 10/2016

* cited by examiner

*Primary Examiner* — Ross N Gushi
(74) *Attorney, Agent, or Firm* — Gerald E. Hespos; Michael J. Porco; Matthew T. Hespos

(57) ABSTRACT

A female connector (F) includes a housing (10) to fit into a receptacle (81) of a male connector (M) and a front retainer (50) to be mounted to a front part of the housing (10). The housing (10) includes a terminal accommodating portion (12) that accommodates female terminal fittings (11). Plate-shaped butting portions (24) extend forward from an outer periphery of the terminal accommodating portion (12) and butt against a back surface of the receptacle (81) when the housing (10) is fit into the receptacle (81). The front retainer (50) includes a cover (51) configured to cover a front end of the terminal accommodating portion (12) by being disposed along inner side surfaces of the butting portions (24) and intrusion preventing portions (54) projecting from the cover (51) to close both sides of clearances between the cover (51) and the butting portions (24) in a front view.

4 Claims, 13 Drawing Sheets

CONNECTOR

BACKGROUND

Field of the Invention

The invention relates to a connector.

Related Art

Japanese Unexamined Patent Publication No. 2016-178076 discloses a connector with a housing to be fit into a receptacle of a mating connector and a front member for covering the front end of the housing. The housing of this connector includes a peripheral wall surrounding the outer periphery of the front member. When the housing is fit into the receptacle of the mating connector, a butting portion of a front part of the peripheral wall butts against the back surface of the receptacle. In this way, the connector is positioned in a connecting direction. Further, in this connector, one panel of the peripheral wall is eliminated for miniaturization.

However, if at least one panel of the peripheral wall is eliminated, a clearance between the peripheral wall and the front member in a front view is open in a direction perpendicular to the connecting direction. Thus, the receptacle of the mating connector may be fit into that clearance at the time of connecting the connector. If the receptacle is fit into the clearance, stress may be concentrated on the butting portion of the peripheral wall to break the butting portion.

The invention was completed on the basis of the above conventional situation and aims to provide a connector capable of preventing the breakage of a butting portion while realizing the miniaturization of the connector.

SUMMARY

The invention is directed to a connector with a housing to be fit into a receptacle of a mating connector, and a front member to be mounted to a front part of the housing. The housing includes a terminal accommodating portion configured to accommodate terminal fittings and a butting portion substantially in the form of a flat plate extends forward from an outer periphery of the terminal accommodating portion. The butting portion is configured to butt against a back surface of the receptacle when the housing is fit into the receptacle. The front member includes a cover configured to cover a front end of the terminal accommodating portion by being disposed along an inner side surface of the butting portion. Intrusion preventing portions project from the cover to close opening parts on both ends of a clearance between the cover and the butting portion in a front view.

According to the invention, entrances to the clearance between the butting portion and the cover are closed by the intrusion preventing portions. Thus, the receptacle cannot enter into the clearance, and stress will not concentrate on the butting portion of the housing to break the butting portion by the entrance of the receptacle into the clearance.

The housing may have a rib projecting in a thickness direction from the butting portion and extending in a front-rear direction. The rib prevents warping during molding of the butting portion. Therefore, expansion of the opening parts on both ends of the clearance between both end parts of the butting portion and the cover in a front view can be suppressed. As a result, the receptacle cannot enter into the clearance through the opening parts.

The rib may project toward the cover from the butting portion, and the front member may include a groove into which the rib is to be fit. Thus, the warping of the butting portion can be prevented more efficiently by ensuring a projecting dimension of the rib.

DETAILED DESCRIPTION

An embodiment of the invention is described with reference to FIGS. 1 to 13. Note that, in the following description, a connecting direction at the time of connection to a male connector M is defined as a forward direction concerning a front-rear direction of a female connector F, and a connecting direction at the time of connection to the female connector F is defined as a forward direction concerning a front-rear direction of the male connector M. Upper and lower sides in FIGS. 1 to 4, 6, 7 and 9 are defined as upper and lower sides concerning a vertical direction. A direction perpendicular to the vertical direction and the front-rear direction is defined as a lateral direction.

<Connector Device>

Figure 1:
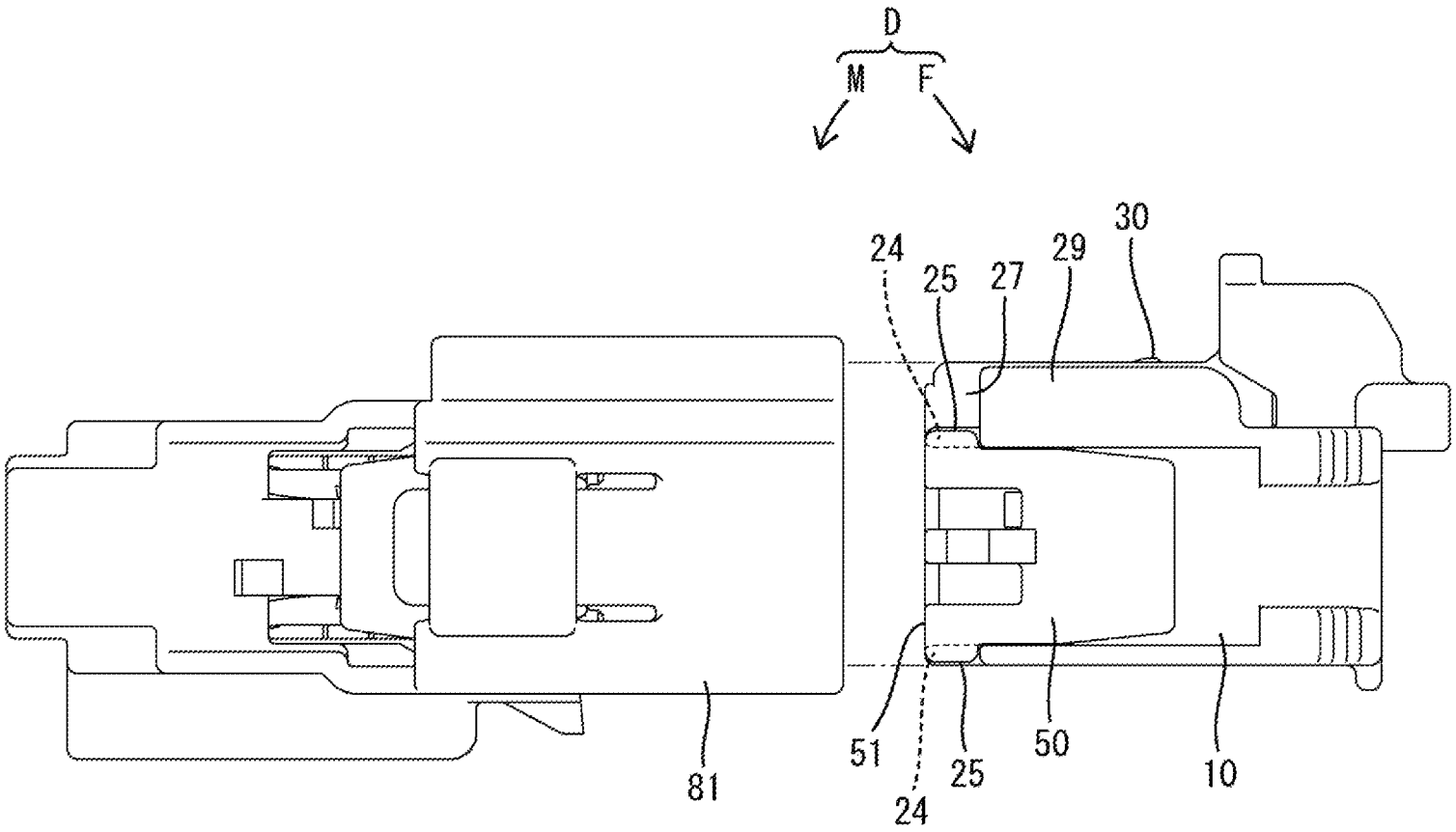
FIG. 1 is a side view of a connector device of one embodiment before connection.
Figure 2:
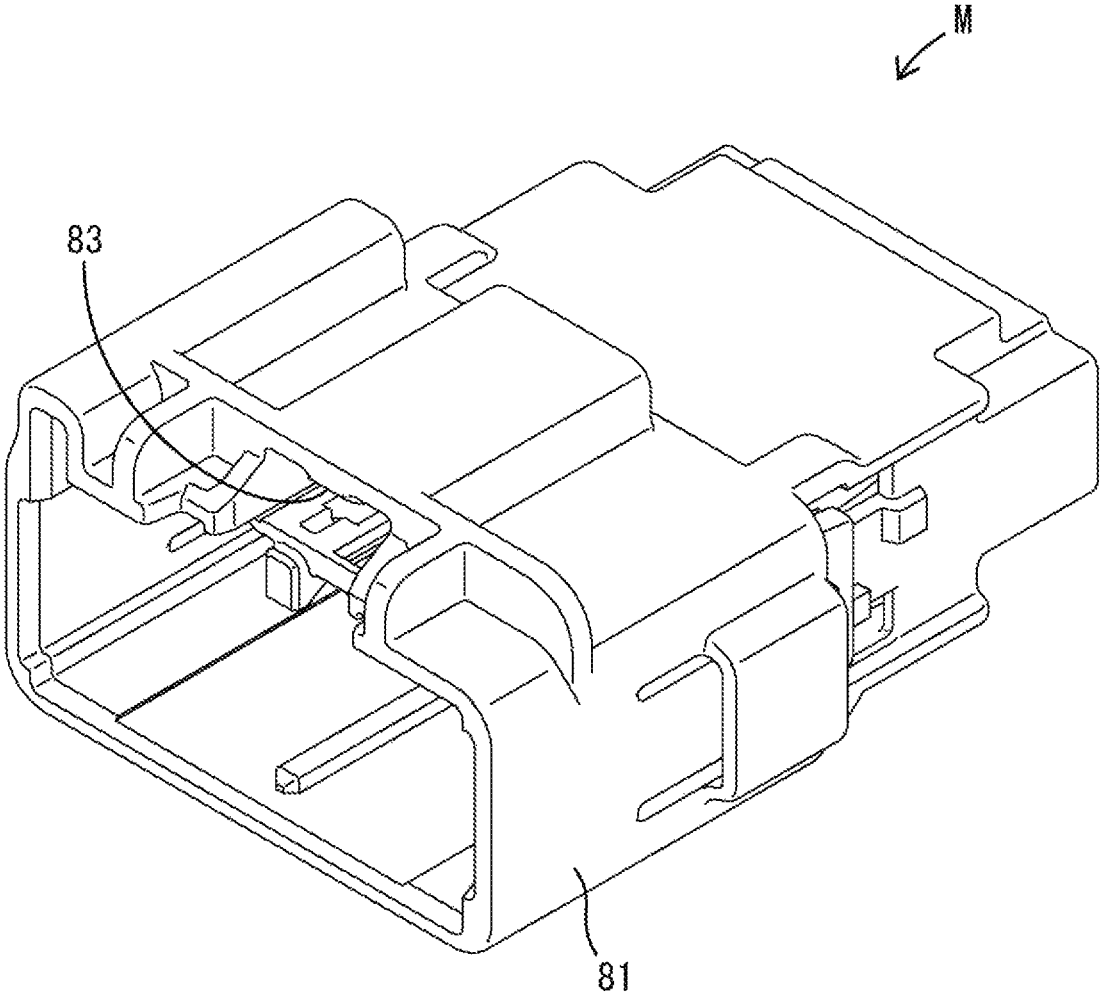
FIG. 2 is a perspective view of a male connector.
Figure 3:
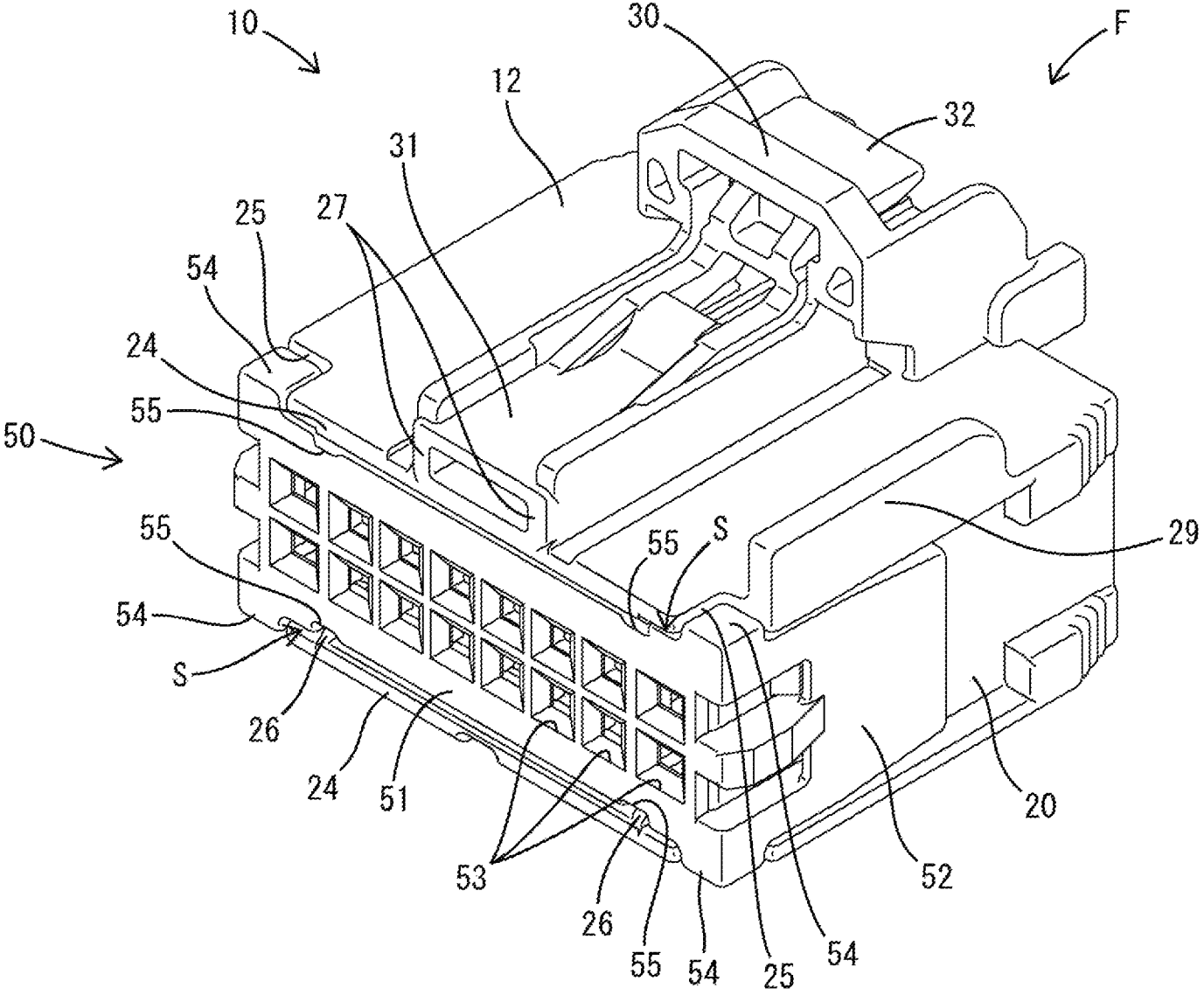
FIG. 3 is a perspective view of a female connector.
Figure 4:
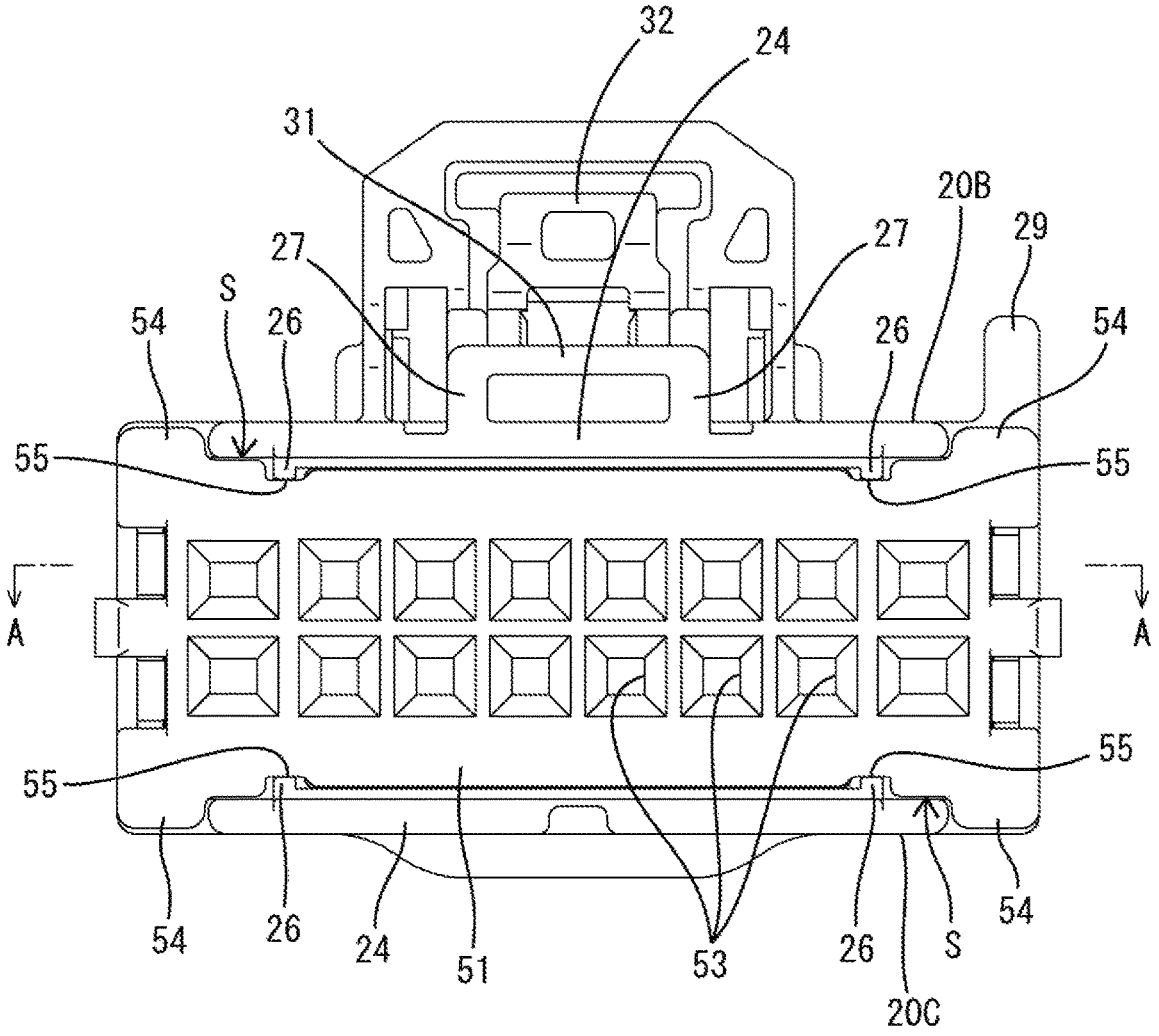
FIG. 4 is a front view of the female connector.
Figure 5:
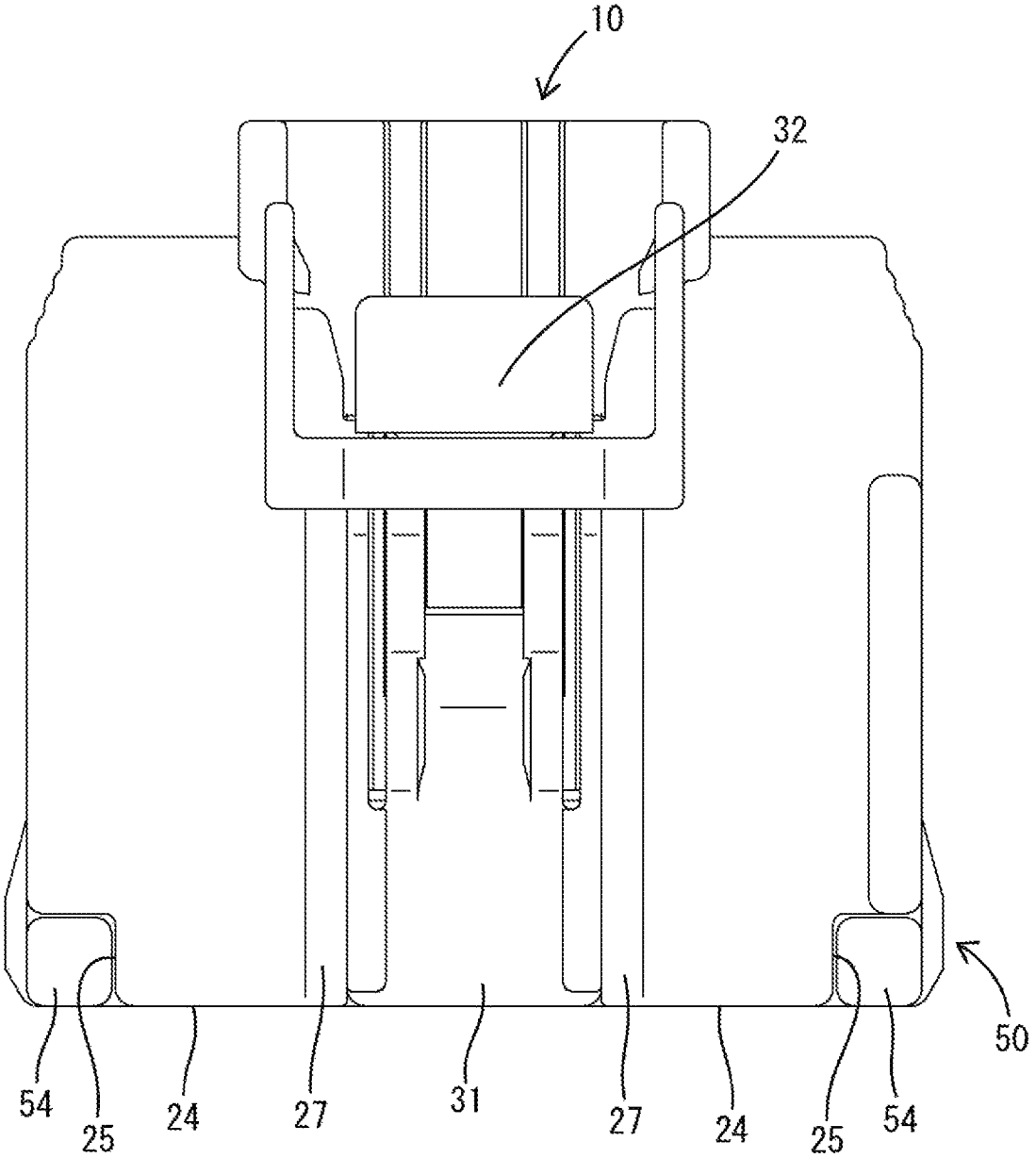
FIG. 5 is a plan view of the female connector.
Figure 6:
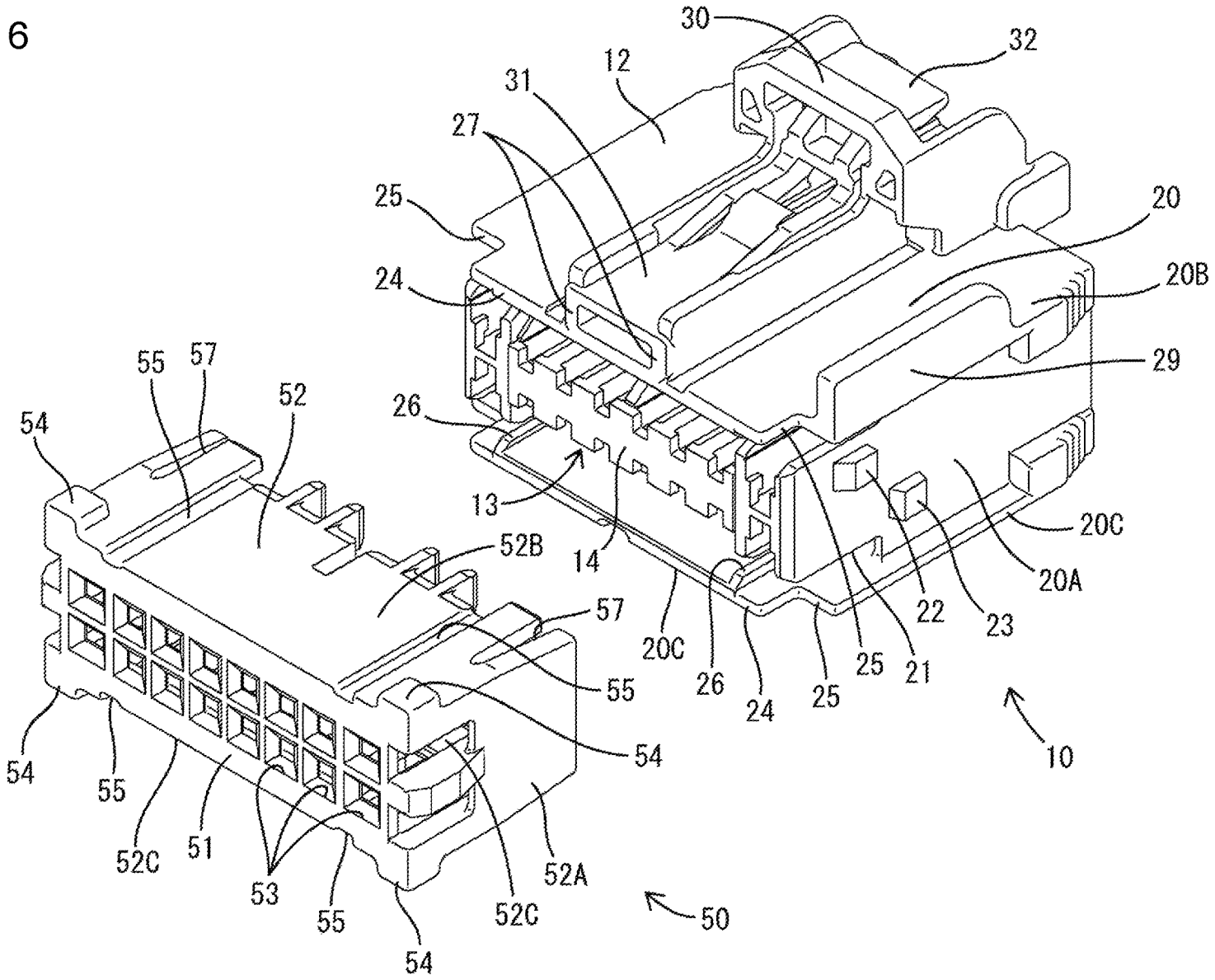
FIG. 6 is an exploded perspective view of the female connector.
Figure 7:
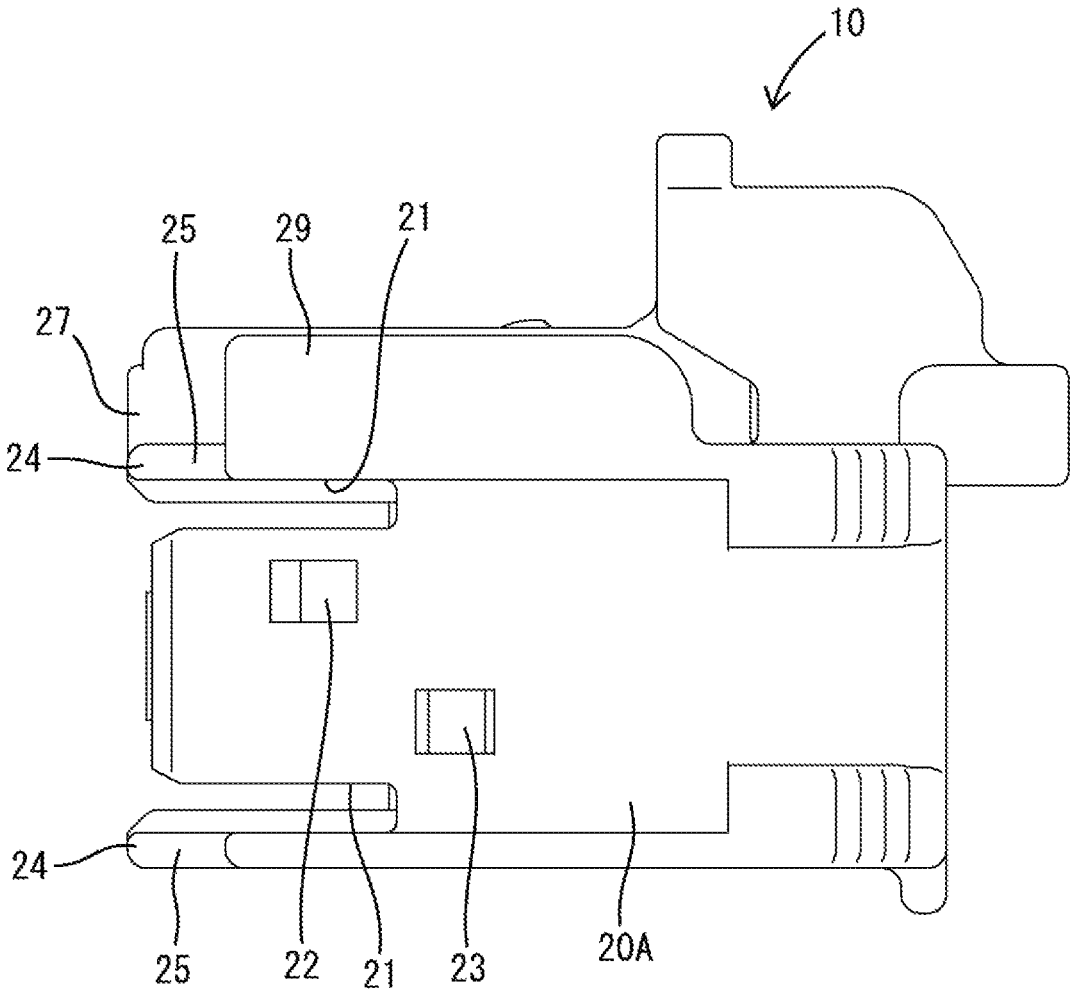
FIG. 7 is a side view of a housing.
Figure 8:
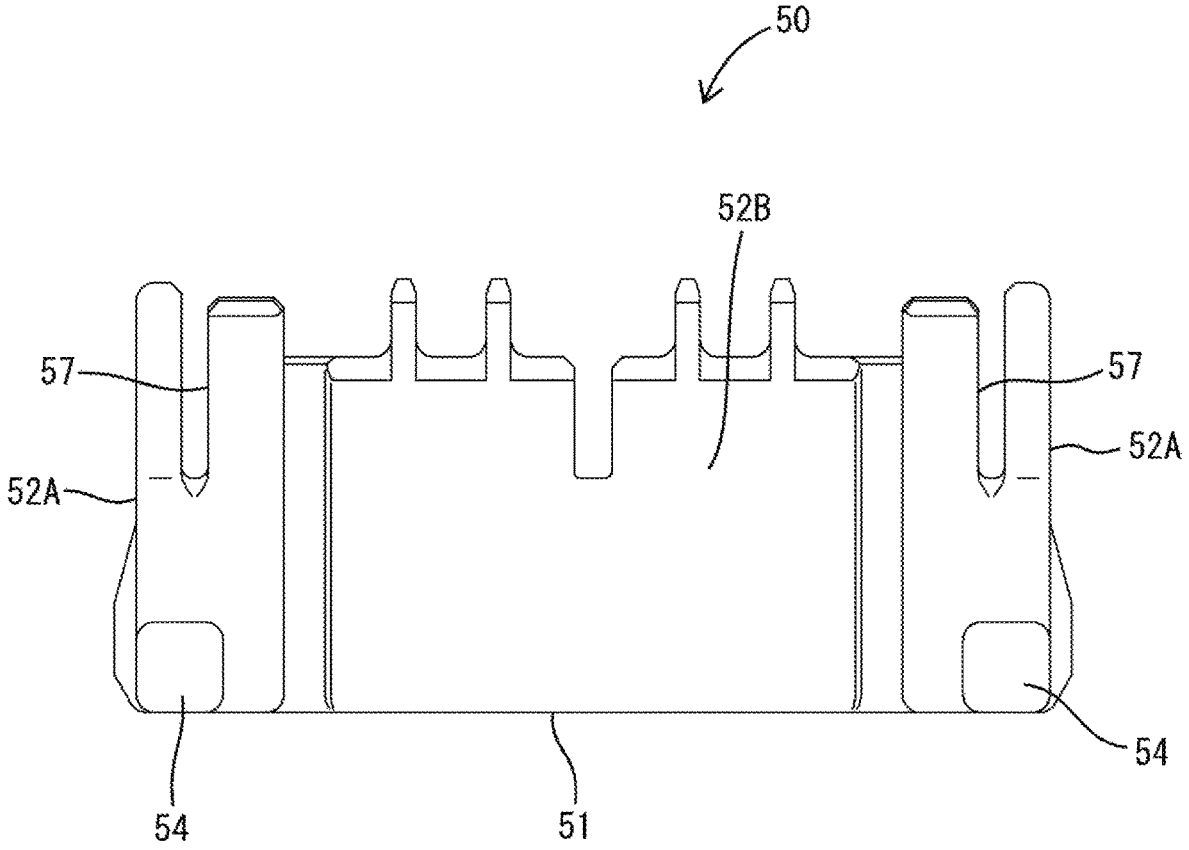
FIG. 8 is a plan view of a front retainer.
Figure 9:
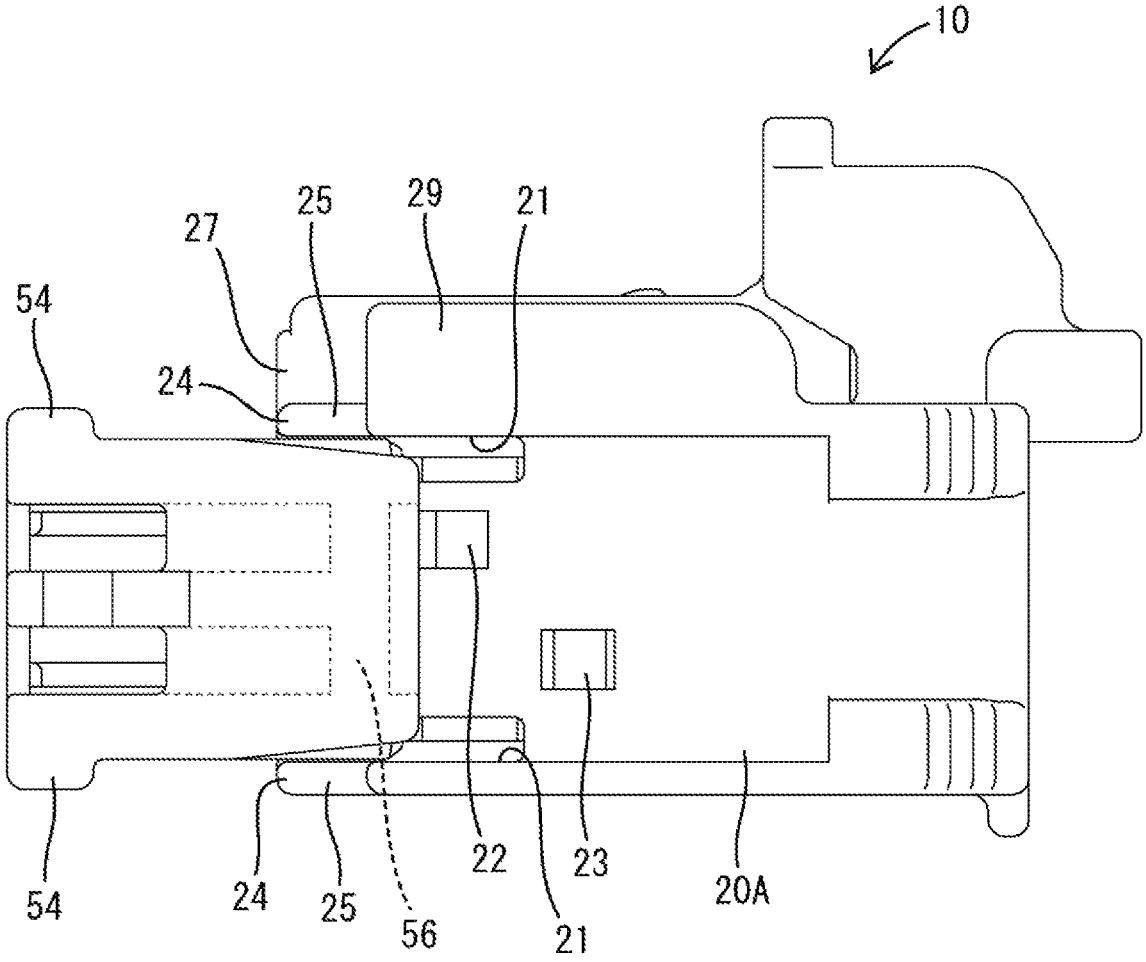
FIG. 9 is a side view of a state before the front retainer is locked to the housing.

A connector device D of this embodiment includes the female connector F equivalent to a "connector" of the invention and the male connector M equivalent to a "mating connector" of the invention as shown in FIG. 1. The male connector M is made of synthetic resin and, as shown in FIG. 2, is formed with a forwardly open receptacle 81. The female connector F is fit into this receptacle 81. An opening part of the receptacle 81 is bilaterally asymmetrically shaped and non-corresponding connectors cannot be inserted. A lock receiving portion 83 is formed on an outer side surface (upper surface in this embodiment) of the receptacle 81. The female connector F is formed with a lock arm 30 to be locked to this lock receiving portion 83 (see FIG. 3). Note that the lock arm 30 is equivalent to a "lock" of the present invention.

The female connector F includes, as shown in FIGS. 3 to 6, a housing 10 made of synthetic resin and a front retainer 50 made of synthetic resin and to be mounted into a front part of the housing 10. Note that the front retainer 50 is equivalent to a "front member" of the present invention.

As shown in FIGS. 3 to 7, the housing 10 includes a terminal accommodating portion 12 for accommodating female terminal fittings 11. The terminal accommodating portion 12 has a substantially rectangular shape long in one direction (lateral direction in this embodiment) in a front view. The terminal accommodating portion 12 includes a terminal holding portion 13 for holding the female terminal fittings 11 arranged in the lateral direction and a peripheral wall 20 continuous with the terminal holding portion 13 and shaped to surround upper, lower, left and right sides of the terminal holding portion 13. The terminal holding portion 13 includes locking lances (not shown) for preventing rearward withdrawal of the female terminal fittings 11 by locking the female terminal fittings 11 inserted from behind. Further, the terminal holding portion 13 constitutes a front part of the terminal accommodating portion 12 and includes a restricting portion 14 for restricting forward movements of the female terminal fittings 11 locked by the locking lances.

The peripheral wall 20 includes left and right side plates 20A, an upper plate 20B and a lower plate 20C. The left and right side plates 20A are at positions retracted laterally inward of left and right side end edges of the upper and lower plates 20B, 20C. Upper and lower end parts of front parts of the left and right side plates 20A are cut off Thus, housing-side slits 21C open forward and to the left and right are formed between the front parts of the left and right side plates 20A and the upper and lower plates 20B, 20C. Central and rear parts of the left and right side plates 20A are continuous with the upper and lower plate portions 20B, 20C. Further, an area connecting the housing-side slits 21 on both left and right sides in a horizontal direction is open forward and both leftward and rightward, and serves as a space into which a part of the front retainer 50 can be accommodated from the front. The front end of the upper plate 20B is aligned with that of the lower plate 20C in the front-rear direction. The front ends of the left and right side plates 20A are disposed slightly before those of the upper and lower plates 20B, 20C. The front ends of the left and right side plates 20A substantially align with that of the terminal holding portion 13 in the front-rear direction. Specifically, the front ends of the upper and lower plates 20B, 20C are slightly behind that of the terminal holding portion 13.

The peripheral wall 20 includes temporary lock receiving portions 22 and complete lock receiving portions 23 projecting out from outer side surfaces of the respective left and right side plates 20A. The complete lock receiving portion 23 is at a predetermined distance from the temporary lock receiving portion 22 and behind the temporary lock receiving portion 22. The temporary lock receiving portions 22 on both left and right sides are aligned in the front-rear direction while being shifted in the vertical direction. Similarly, the complete lock receiving portions 23 on left and right sides are aligned in the front-rear direction while being shifted in the vertical direction.

The housing 10 includes butting portions 24 in the form of flat plates extending forward from the front ends of the upper and lower plates 20B, 20C (peripheral wall 20) of the terminal accommodating portion 12. The butting portions 24 are flush with the upper and lower plates 20B, 20C. Left and right ends of the butting portions 24 are at positions retracted inward of both left and right ends of the upper and lower plates 20B, 20C. Specifically, a formation range of the butting portions 24 is smaller than that of the terminal accommodating portion 12 in a length direction (lateral direction in this embodiment) of the butting portions 24 in a front view.

The left and right side plates 20A are disposed laterally outward of both left and right ends of the butting portions 24. Specifically, the left and right side plates 20A are disposed between the both left and right end edges of the butting portions 24 and the left and right ends of the upper and lower plates 20A, 20B in a front view. The front ends of the left and right side plates 20A and that of the terminal holding portion 13 are disposed rearward of the front ends of the butting portions 24, and disposed forward of the rear ends of the butting portions 24 (front ends of the upper and lower plate portions 20B, 20C).

The housing-side slits 21 are laterally outward of the left and right end edges of the butting portions 24. Specifically, the housing-side slits 21 are between the left and right ends of the butting portions 24 and the left and right ends of the upper and lower plates 20B, 20C in a front view. The front ends of the housing-side slits 21 are at positions slightly behind the front ends of the butting portions 24 and in front of the rear ends of the butting portions 24 (front ends of the upper and lower plate portions 20B, 20C). The housing-side slits 21 extend to positions rearward of the rear ends of the butting portions 24.

The housing 10 is formed with cut portions 25 defined by both lateral end edges of the butting portions 24 and the front edges of both left and right end parts of the upper and lower plates 20B, 20C and cut into a substantially rectangular shape in a plan view.

Inner ribs 26 projecting in facing directions (inward, toward the space where the front retainer 50 is to be accommodated, toward the front retainer 50) from surfaces facing each other and extending in the front-rear direction are formed on the upper and lower butting portions 24 and front parts of the upper and lower plates 20B, 20C. One inner rib 26 is provided on each of both left and right end parts of the butting portions 24 and the upper and lower plates 20B, 20C. The front ends of the inner ribs 26 substantially align with those of the butting portions 24. A formation range of the aforementioned housing-side slits 21 in the front-rear direction is substantially the same as that of the inner ribs 26 in the front-rear direction. Note that the inner ribs 26 are equivalent to a "rib" of the present invention.

The upper butting portion 24 and the upper plate 20B (housing 10) are formed with outer ribs 27 projecting out (up in this embodiment) from outer side surfaces (upper surfaces in this embodiment) and extending in the front-rear direction. The front ends of the outer ribs 27 are aligned with those of the butting portions 24. Further, the front ends of the outer ribs 27 are located slightly forward of those of the housing-side slits 21, and the outer ribs 27 extend to positions rearward of the rear ends of the housing-side slits 21. The outer ribs 27 are formed in a laterally central part. Two outer ribs 27 are disposed parallel to each other. Note that a predetermined number of (one in this embodiment) erroneous connection preventing rib(s) 29 extending parallel to the outer ribs 27 is/are formed on the surface of the housing 10 where the outer ribs 27 are provided.

The upper butting portion 24 and the upper plate 20B (housing 10) are formed with the lock arm 30. The lock arm 30 constitutes parts of the outer ribs 27, and includes a connecting portion 31 linking the outer ribs 27 to each other while being spaced apart from the butting portion 24 and a cantilevered resilient locking piece 32 configured to be resiliently displaced with the connecting portion 31 as a support. The front end of the connecting portion 31 is aligned with those of the butting portions 24 in the front-rear direction.

The front retainer 50 has substantially the same shape (rectangular shape) as the terminal accommodating portion 12 in a front view. The front retainer 50 includes a cover 51 in the form of a flat plate covering the front surface of the terminal accommodating portion 12 (terminal holding portion 13) and having a rectangular shape in a front view, and an extending portion 52 extending rearward from the outer periphery of the cover 51. The cover 51 is formed with insertion holes 53 to receive male terminal fittings (not shown) to be connected to the respective female terminal fittings 11. Intrusion preventing portions 54 projecting in the vertical direction are formed on four corners (both left and right end parts of both upper and lower end parts) of the cover 51 in a front view. The front surfaces of the intrusion preventing portions 54 are continuous and flush with the front surface of the cover 51. Both left and right outer side surfaces of the intrusion preventing portions 54 are continuous and flush with both outer side surfaces of the covers 51.

Grooves 55 are formed in the upper and lower end surfaces of the cover 51 and the extending portion 52 (front retainer 50) for receiving the inner ribs 26 of the housing 10. The extending portion 52 includes left and right side plates 52A, an upper plate 52B and a lower plate 52C. Locking ribs 56 to be locked to the temporary lock receiving portions 22 or complete lock receiving portions 23 of the housing 10 are formed on the inner surfaces of the left and right side plates 52A of the extending portion 52. A width of the locking rib 56 is equal to or slightly smaller than an interval between the temporary lock receiving portion 22 and the complete lock receiving portion 23. The extending portion 52 is formed with front-side slits 57 extending in the front-rear direction and open rearward at positions corresponding to the housing-side slits 21 in a front view (see FIG. 8).

<Assembling of Connector Device D>

Figure 10:
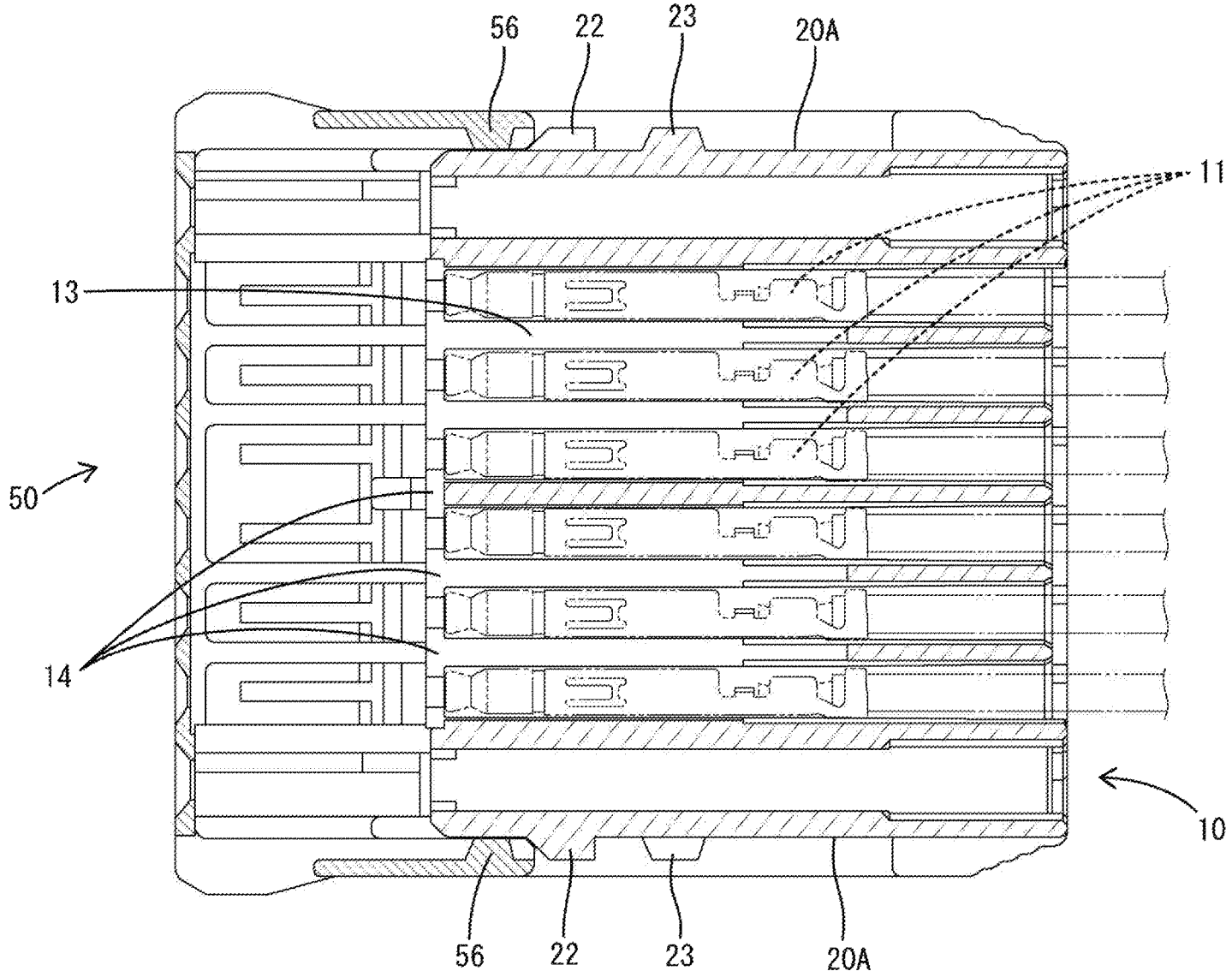
FIG. 10 is a section along A-A showing the state before the front retainer is locked to the housing.
Figure 11:
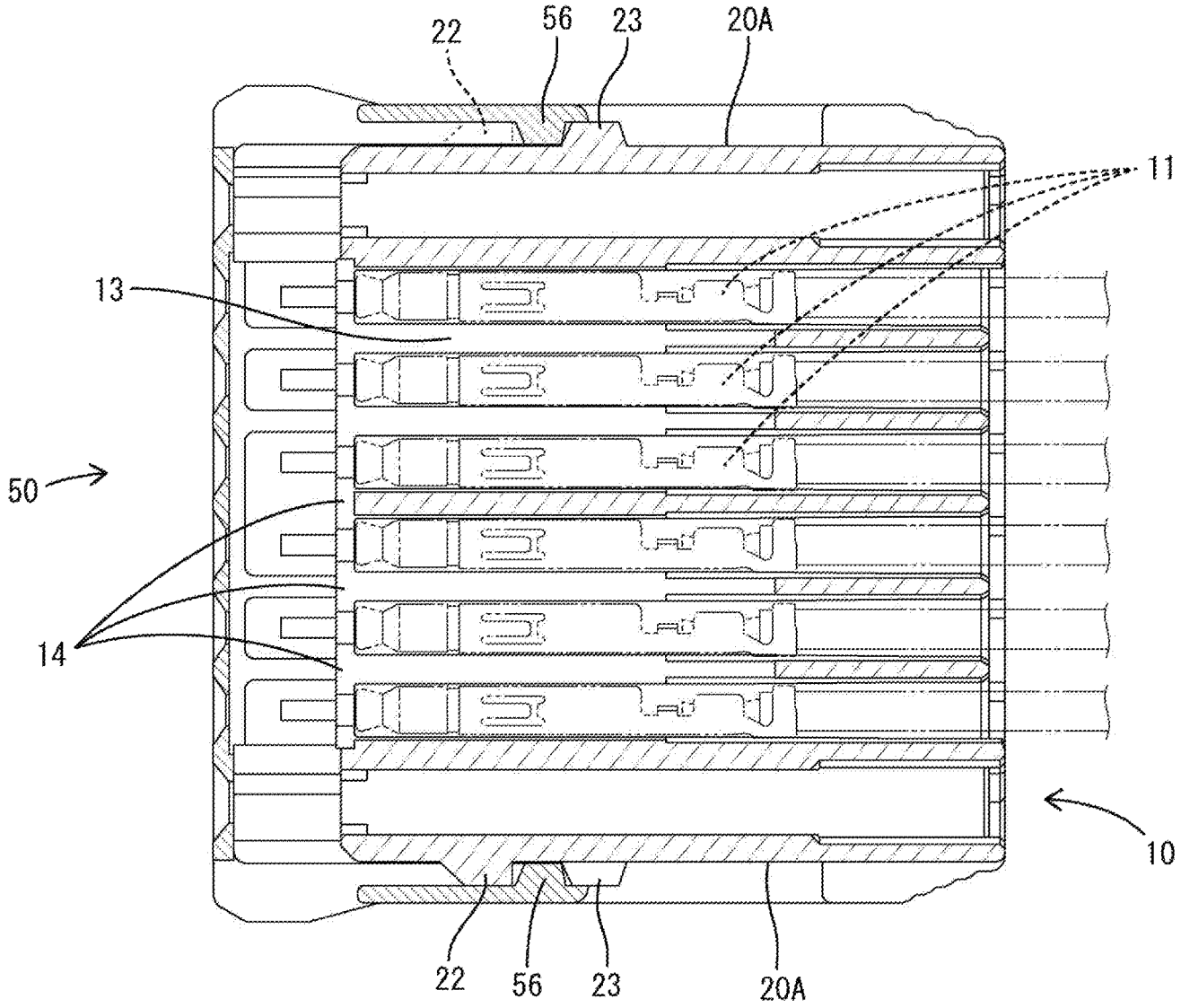
FIG. 11 is a section along A-A showing a state where the front retainer is temporarily locked to the housing.
Figure 12:
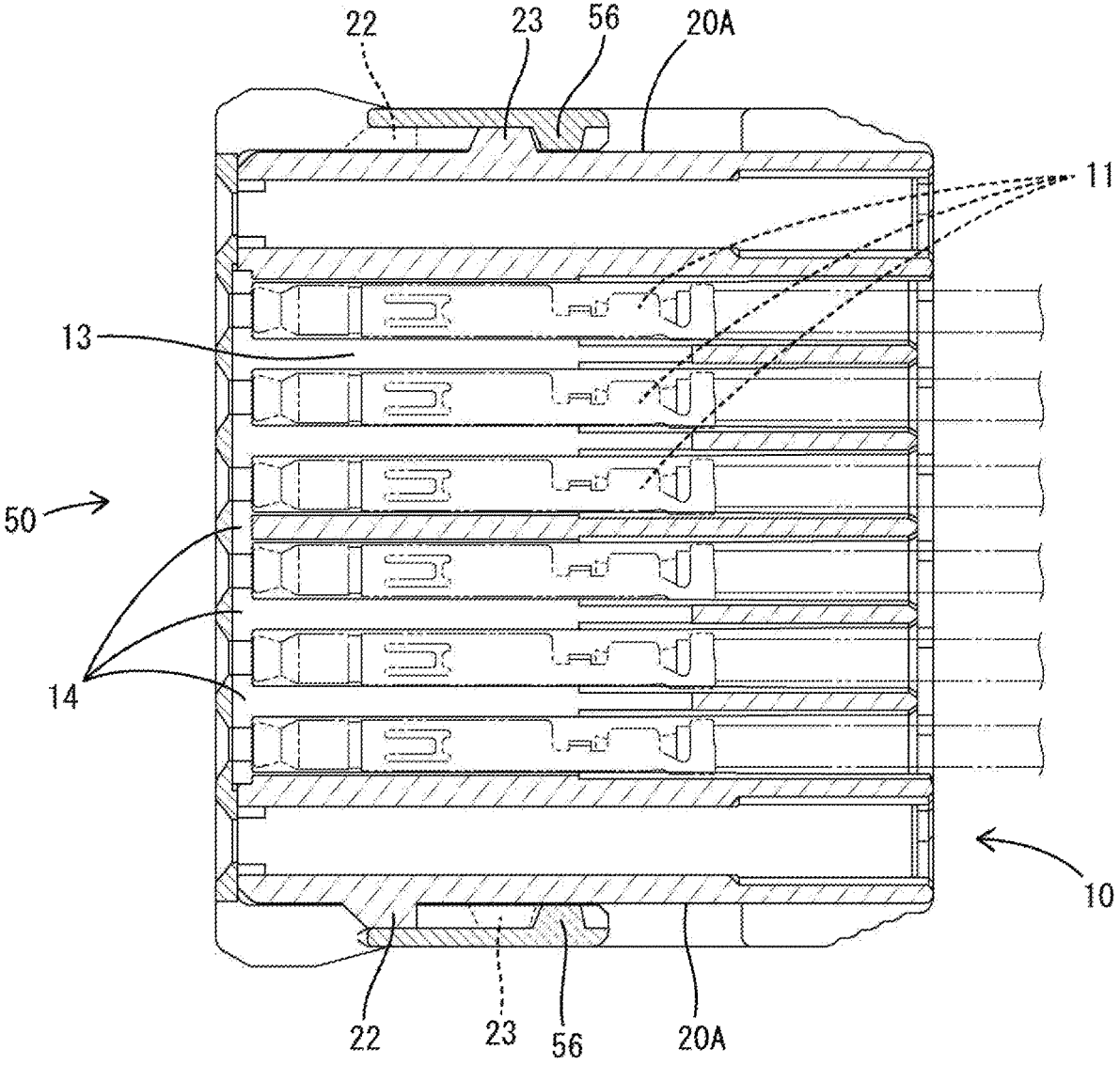
FIG. 12 is a section along A-A showing a state where the front retainer is completely locked to the housing.

In the assembling of the female connector F, the front retainer 50 is assembled with the housing 10 from front as shown in FIGS. 9 to 12. The front retainer 50 moves in an assembling direction along the inner surfaces of the upper and lower butting portions 24 (terminal accommodating portion 12) when being assembled with the housing 10. At this time, the grooves 55 of the front retainer 50 are fit to the inner ribs 26 and move in the assembling direction along the inner ribs 26. Further, the left and right side plates 52A of the extending portion 52 of the front retainer 50 move in the assembling direction along the outer side surfaces of the left and right side plates 20A of the housing 10, as shown in FIG. 10. When the front retainer 50 moves in the assembling direction, the front-side slits 57 are fit into the housing-side slits 21. Further, the locking ribs 56 move onto the temporary lock receiving portions 22 to be deflected outward and return to an initial shape after moving over the temporary lock receiving portions 22 to achieve a temporarily locked state (see FIG. 11). In the temporarily locked state, the locking ribs 56 are fit between the temporary lock receiving portions 22 and the complete lock receiving portions 23 and displacements of the locking ribs 56 in the front-rear direction are restricted by the temporary lock receiving portions 22 and the complete lock receiving portions 23. When the front retainer 50 further moves in the connecting direction, the locking ribs 56 move onto the complete lock receiving portions 23 to deflect out and return to an initial shape after moving over the complete lock receiving portions 23 to set a completely locked state (see FIG. 12).

Figure 13A:
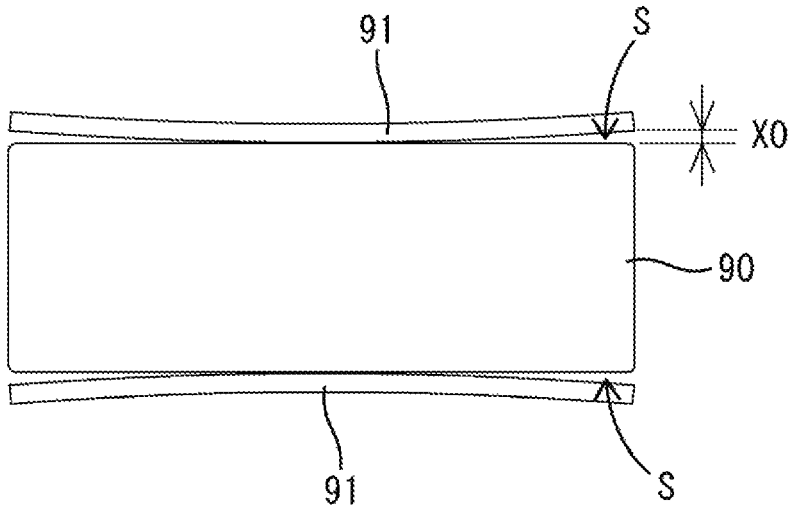
FIG. 13(A) is a view conceptually showing opening dimensions between both end parts of butting portions and a cover portion when a width of the butting portions is equal to that of the cover portion as a comparative example and FIG. 13(B) is a view conceptually showing opening dimensions between both end parts of butting portions and a cover portion when a width of the butting portions is smaller than that of the cover portion.
Figure 13B:
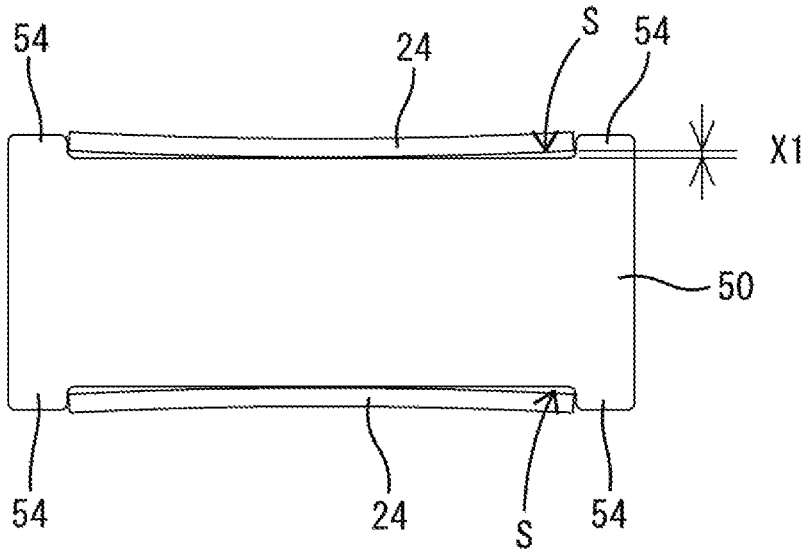

In the completely locked state, the cover 51 (front retainer 50) is disposed along the inner surfaces of the butting portions 24 and between the upper and lower plates 20B, 20C. Further, a formation range of the butting portions 24 is smaller than that (width) of the cover 51 in a length direction (lateral direction in this embodiment) of the butting portions 24 in a front view. This can suppress the expansion of openings of clearances S at both left and right ends formed between the both end parts of the butting portions 24 and the cover 51 in a front view due to the warping of the butting portions 24 during molding. Specifically, if a curvature of warp generated during the molding of the butting portions 24 is thought to be constant regardless of a plate width of the butting portions 24, the expansion of the opening dimension can be suppressed by making the plate width of the butting portions 24 smaller. For example, as in a comparative example shown in FIG. 13(A), an opening dimension is X0 if a formation range of butting portions 91 is equal to that of a cover 90 in a length direction of the butting portions 91 in a front view. In contrast, the opening dimension is X1 smaller than X0 as shown in FIG. 13(B) if the formation range of the butting portions 24 is smaller than that of the cover 51 in the length of the butting portions 24 in a front view.

In the completely locked state, the cover 51 protrudes farther out than the butting portions 24 in the length direction of the butting portions 24 in a front view. The intrusion preventing portions 54 project toward the butting portion 24 (upper and lower sides) from protruding parts of the cover 51 to close opening parts on both ends of the clearances S between the cover 51 and the butting portions 24 in a front view. Specifically, the intrusion preventing portions 54 are disposed on extensions of the clearances S in the length direction of the butting portions 24 in a front view and prevent the intrusion of the receptacle 81 of the male connector M into the clearances S in the length direction of the butting portion 24 in a front view. Further, the intrusion preventing portions 54 project to fill the cut portions 25 of the housing 10. Specifically, both left and right ends of upper and lower edge parts in the front part of the female connector F are constituted by the intrusion preventing portions 54 of the front retainer 50, and the butting portions 24 are disposed adjacent to and between the left and right intrusion preventing portions 54. The front ends of the intrusion preventing portions 54 are substantially aligned with those of the butting portions 24 in the front-rear direction. Projecting end surfaces of the intrusion preventing portions 54 are substantially flush with the vertically outer surfaces of the butting portions 24 (terminal accommodating portion 12). The projecting end surfaces (upper end surfaces, lower end surfaces) of the intrusion preventing portions 54 are not covered by the butting portions 24 and vertically exposed to outside. The rear surfaces of the intrusion preventing portions 54 rise along front end edges of both left and right end parts of the upper and lower plates 20B, 20C. Both left and right inner surfaces of the intrusion preventing portions 54 rise along both left and right end edges of the butting portions 24. The front end of the front retainer 50 is aligned with or behind those of the butting portions 24 in the front-rear direction.

The female connector F in the completely locked state is fit into the receptacle 81 of the male connector M. At this time, in the case of a connector like the comparative example shown in FIG. 13(A), both ends of the clearances S are open on left and right sides. Thus, the receptacle 81 may enter these opening parts. If the receptacle 81 enters the clearances S, stress may be concentrated on the butting portions 24 to break the butting portions 24.

In contrast, in the female connector F of this embodiment, the opening parts on both ends of the clearances S are closed by the intrusion preventing portions 54. Thus, the female connector F can be fit into the receptacle 81 without the receptacle 81 entering the opening parts on the both ends of the clearances S. When the intrusion preventing portions 54 of the female connector F are accommodated into the receptacle 81, the female connector F and the male connector M are arranged to face in front of each other with the intrusion preventing portions 54 kept accommodated in the receptacle 81. At this time, the outer side surfaces of the butting portions 24 are disposed to be substantially flush with the outer side surfaces of the intrusion preventing portions 54 or vertically outward (inward) of the outer side surfaces of the intrusion preventing portions 54. Accordingly, the receptacle 81 enters along the outer side surfaces of the butting portions 24 (along outer sides of the outer side surfaces of the butting portions 24). Thus, the receptacle 81 cannot enter into the clearances S between the butting portions 24 and the cover 51. The outer ribs 27 of the female connector F move along the lock receiving portion 83 of the male connector M when the female connector F is arranged to face the male connector M and is inserted into the receptacle 81. The lock arm 30 is pressed by the lock receiving portion 83 and deflects down when the female connector F is inserted in that state. The lock arm 30 returns to an initial shape and is locked to the lock receiving portion 83 when a locking claw of the lock arm 30 moves over the lock receiving portion 83. In this way, the female connector F is connected to the male connector M.

<Functions and Effects of Embodiment>

As described above, the female connector F of this embodiment includes the housing 10 to be fit into the receptacle 81 of the male connector M, and the front retainer 50 to be mounted into the front part of the housing 10. The housing 10 includes the terminal accommodating portion 12 to accommodate the female terminal fittings 11. The butting portions 24 in the form of substantially flat plates extend forward from the outer peripheral edge of the terminal accommodating portion 12 and are configured to butt against the back surface of the receptacle 81 when the housing 10 is fit into the receptacle 81. The front retainer 50 includes the cover 51 configured to cover the front end of the terminal accommodating portion 12 by being disposed along the inner surfaces of the butting portions 24. Additionally, the intrusion preventing portions 54 project from the cover 51 to close the opening parts on the end parts of the clearances S between the cover 51 and the butting portions 24 in a front view. In this way, entrances to the clearances S between the butting portions 24 and the cover 51 are closed by the intrusion preventing portions 54 to prevent the entrance of the receptacle 81 into the clearances S. Therefore, stress is not likely to concentrate on and break the butting portions 24 due to the entrance of the receptacle 81 into the clearances S.

The housing 10 includes the inner ribs 26 and the outer ribs 27 projecting in a thickness direction of the butting portions 24 from the butting portions 24 and extending in the front-rear direction. The ribs 26, 27 suppress warping of the butting portions 24 during molding. Thus, opening parts on both ends of the clearances S between the end parts of the butting portions 24 and the cover 51 are unlikely to expand, thereby preventing entry of the receptacle 81 into the clearances S between the butting portions 24 and the cover 51.

The front retainer 50 includes the grooves 55 into which the inner ribs 26 are to be fit. In this way, the warping of the butting portions 24 is prevented by ensuring a projecting dimension of the inner ribs 26.

The female connector F includes the housing 10 to be fit into the receptacle 81 of the male connector M, and the front retainer 50 to be mounted into the front part of the housing 10. The housing 10 includes the terminal accommodating portion 12 configured to accommodate the female terminal fittings 11. Substantially flat plate-shaped butting portions 24 extend forward from the outer periphery of the terminal accommodating portion 12 and are configured to butt against the back surface of the receptacle 81 when the housing 10 is fit into the receptacle 81. The front retainer 50 includes the cover 51 configured to cover the front end of the terminal accommodating portion 12 by being disposed along the inner surfaces of the butting portions 24. The formation range of the butting portions 24 is smaller than that of the cover 51 in the length direction of the butting portions 24 in a front view. Thus, the butting portions 24 are not likely to warp during molding, and the clearances S between the end parts of the butting portions 24 and the cover 51 are not likely to expand. This dimensional control makes it difficult for the receptacle 81 to enter the clearances S between the butting portions 24 and the cover 51. Thus, stress is less likely to concentrate on and break the butting portions 24 by the entrance of the receptacle 81 into the clearances S when the female connector F is connected to the male connector.

The housing 10 includes the outer ribs 27 projecting toward the side opposite to the cover 51 from the butting portions 24 and extending in the front-rear direction. Since warping during the molding of the butting portions 24 can be suppressed in this way, the expansion of the opening parts on the both ends of the clearances S between the end parts of the butting portions 24 and the cover 51 in a front view can be suppressed more reliably.

The front ends of the outer ribs 27 are aligned with those of the butting portions 24 in the front-rear direction. If the butting portion 24 is thin, a testing tool is not stabilized by being inclined in the thickness direction of the butting portion 24 or slipping even if an attempt is made to measure the position in the front-rear direction by pressing the testing tool against the front end of the butting portion 24. In this respect, according to the invention, the testing tool can be pressed reliably against the front end of the butting portion 24 by being pressed against an intersecting part of the butting portion 24 and the outer rib 27. Accordingly, the position of the front end of the butting portion 24 in the front-rear direction can be precisely grasped, and a forward projecting dimension of the front retainer 50 from the front end of the butting portion 24 can be measured. Further, the outer ribs 27 are provided in the laterally central part. In pressing the testing tool against the front end of the butting portion 24, it is also considered to press the testing tool against an intersecting part of the erroneous connection preventing rib 29 provided on one lateral one and the butting portion 24, but the position of the erroneous connection preventing rib 29 differs depending on the type of the connector. Thus, the pressing position varies depending on the type of the connector. In contrast, since the outer ribs 27 are provided in the laterally central part in the female connector F, the pressing position remains unchanged regardless of the type of the connector.

The front retainer 50 includes the intrusion preventing portions 54 projecting from the cover 51 to close the opening parts on the both end parts of the clearances S formed between the cover 51 and the butting portions 24 in a front view. Since the entrances to the clearances S between the butting portions 24 and the cover 51 are closed by the intrusion preventing portions 54 in this way, the entrance of the receptacle 81 into the clearances S can be prevented.

Thus, stress is less likely to concentrate on and break the butting portions 24 by the entrance of the receptacle 81 into the clearances S.

The housing 10 includes the inner ribs 26 projecting toward the cover 51 from the butting portions 24 and extending in the front-rear direction. Since warping during the molding of the butting portions 24 can be suppressed in this way, the expansion of the opening parts on the ends of the clearances S between the end parts of the butting portions 24 and the cover 51 in a front view can be more reliably suppressed.

The connector device D of this embodiment includes the female connector F and the male connector M. The female connector F includes the lock arm 30 and the male connector M includes the lock receiving portion 83 to be locked to the lock arm 30. The outer ribs 27 of the female connector F guide the lock arm 30 in a direction to be locked to the lock receiving portion 83. In this way, the outer ribs 27 of the female connector F can also be utilized as guides for guiding the female connector F in a direction to be locked to the male connector M.

The lock arm 30 includes the cantilevered resilient locking piece using the outer ribs 27 as supports. Thus, a form for the female connector F can be simplified in shape as compared to the case where a support of the lock arm 30 and the outer ribs 27 are separated. Thus, resin satisfactorily spreads and a molding failure is unlikely to occur.

The invention is not limited to the above described and illustrated embodiment. For example, the following embodiments also are included in the scope of the invention.

In the above embodiment, the front member is the front retainer. However, any member other than the front retainer may be used if this member can cover the front end of the terminal accommodating portion. For example, a front mask may be used.

In the above embodiment, the butting portions are provided at two upper and lower positions of the housing. However, butting portions may be provided on left and right sides instead of upper and lower sides or one butting portion may be provided only at one position.

LIST OF REFERENCE SIGNS

D . . . connector device
F . . . female connector (connector)
M . . . male connector (mating connector)
10 . . . housing
11 . . . female terminal fitting (terminal fitting)
12 . . . terminal accommodating portion
24 . . . butting portion
26 . . . inner rib (rib)
27 . . . outer rib
30 . . . lock arm (lock portion)
50 . . . front retainer (front member)
51 . . . cover
54 . . . intrusion preventing portion
55 . . . groove
81 . . . receptacle
83 . . . lock receiving portion

What is claimed is:

1. A connector, comprising:

a housing to be fit into a receptacle of a mating connector, the housing including a terminal accommodating portion configured to accommodate terminal fittings, the terminal accommodating portion including a front end, a butting portion substantially in the form of a flat plate extending forward toward the front end of the terminal accommodating portion and configured to butt against a back surface of the receptacle when the housing is fit into the receptacle, the butting portion further having opposite side edges extending rearward from the front edge and a clearance being defined between the butting portion and the terminal accommodating portion, the clearance being open forwardly at the front edge of the butting portion and being open laterally at the side edges of the butting portion; and a front member to be mounted on the housing, the front member including a cover configured to cover the front end of the terminal accommodating portion and an extending portion projecting rearward from the cover, the extending portion being fit into the clearance in the housing so that the extending portion is disposed between an inner surface of the butting portion and the terminal accommodating portion, intrusion preventing portions projecting from the cover at positions spaced laterally from the extending portion and having projecting ends aligned laterally with the side edges of the butting portion to close the clearance between the cover and the butting portion laterally of the side edges of the butting portion.

2. The connector of claim 1, wherein the butting portion has an outer surface facing outward and away from the terminal accommodating portion, the outer surface of the butting portion being farther outward than the intrusion preventing portions with respect to projecting directions of the intrusion preventing portions.

3. The connector, comprising:

a housing to be fit into a receptacle of a mating connector; and a front member to be mounted to a front part of the housing;

the housing including a terminal accommodating portion configured to accommodate terminal fittings and a butting portion substantially in the form of a flat plate extending forward from an outer peripheral edge of the terminal accommodating portion and configured to butt against a back surface of the receptacle) when the housing is fit into the receptacle; and the front member including a cover configured to cover a front end of the terminal accommodating portion by being disposed along an inner side surface of the butting portion and intrusion preventing portions projecting from the cover to close both sides of a clearance between the cover and the butting portion in a front view, wherein the housing includes a rib projecting in a thickness direction from the butting portion and extending in a front-rear direction.

4. The connector of claim 3, wherein:

the rib projects toward the cover from the butting portion; and the front member includes a groove into which the rib is to be fit.

* * * * *